US009294845B2

(12) United States Patent
Cai et al.

(10) Patent No.: US 9,294,845 B2
(45) Date of Patent: Mar. 22, 2016

(54) MINIATURE SPEAKER

(71) Applicants: Bin Cai, Shenzhen (CN); Yunxia Xu, Shenzhen (CN)

(72) Inventors: Bin Cai, Shenzhen (CN); Yunxia Xu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 14/287,129

(22) Filed: May 26, 2014

(65) Prior Publication Data

US 2015/0181345 A1 Jun. 25, 2015

(30) Foreign Application Priority Data

Dec. 23, 2013 (CN) ..... 2013 2 0853461 U

(51) Int. Cl.

| | |
|---|---|
| ***H04R 9/02*** | (2006.01) |
| ***H04R 31/00*** | (2006.01) |
| ***H04R 9/06*** | (2006.01) |
| ***H04R 1/06*** | (2006.01) |

(52) U.S. Cl.

CPC .. *H04R 9/06* (2013.01); *H04R 1/06* (2013.01); *H04R 9/02* (2013.01); *H04R 31/006* (2013.01); *H04R 2400/11* (2013.01)

(58) Field of Classification Search

CPC ..... H04R 1/025; H04R 9/043; H01R 12/7076

See application file for complete search history.

(56) References Cited

U.S. PATENT DOCUMENTS

| | | | | |
|---|---|---|---|---|
| 4,852,178 | A * | 7/1989 | Inkman et al. | 381/395 |
| 7,200,241 | B2 * | 4/2007 | Fukuyama et al. | 381/407 |
| 8,094,867 | B2 * | 1/2012 | Chang et al. | 381/412 |
| 2009/0142961 | A1 * | 6/2009 | Chen et al. | 439/626 |
| 2013/0016874 | A1 * | 1/2013 | Huang et al. | 381/433 |
| 2013/0094685 | A1 * | 4/2013 | Seo et al. | 381/332 |
| 2014/0023223 | A1 * | 1/2014 | Hwang et al. | 381/386 |

* cited by examiner

*Primary Examiner* — Fan Tsang
*Assistant Examiner* — Angelica M McKinney
(74) *Attorney, Agent, or Firm* — IPro, PLLC; Na Xu

(57) ABSTRACT

A miniature speaker is disclosed. The miniature speaker includes a frame, a magnetic circuit received in the frame, a voice coil partially received in the magnetic circuit, a diaphragm connected to the voice coil, and a contact fixed by the frame for electrically connecting the voice coil to an external circuit. The contact includes an elastic arm, and a latch located at a position between two ends of the elastic arm. Corresponding to the latch, the frame includes a protrusion engaging with the latch for restricting the upward movement of the elastic arm.

7 Claims, 5 Drawing Sheets

MINIATURE SPEAKER

FIELD OF THE INVENTION

The present invention relates to electro-acoustic transducers, more particularly to a miniature speaker having elastic contacts for electrically connecting to an external circuit.

DESCRIPTION OF RELATED ART

With the rapid development of wireless communication technologies, mobile phones are widely used. Users require mobile phones to not only have voice function, but also have high quality acoustic performance. A mobile phone also provides the user with entertainment contents, such as music, video, game. For converting electrical signals to audible sounds, a speaker is a necessary component used in a mobile phone for generating sounds. With the mobile phone is designed to be smaller and smaller, the speaker used therein is also required to have a low profile with small size.

Generally, a miniature speaker related to the present disclosure electrically connects to external circuits via elastic contacts. Such a miniature speaker includes a frame, a sound generator accommodated in the frame, and contacts positioned by the frame. Generally, the contact is mounted on a lower surface of the frame and includes an elastic arm for connecting with the external circuits. For ensuring the stable connection between the contact and the external circuit, the contact is usually made of metal capable of elastic deformation. In addition, for protecting the elastic arm, the contact further includes a hook engaging with a restricting member for restrict the deformation of the elastic arm. Ordinarily, the hook is configured to be at the end of the elastic arm, which elongates the length of the elastic arm, and increases the whole size of the contact. A contact with increased size conflicts with the trend of the mobile phone to small size. And, the increased size badly affects the stability of the connection between the contact and the external circuit.

Accordingly, an improved miniature speaker which can overcome the disadvantages described above is desired.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment.

Figure 1:
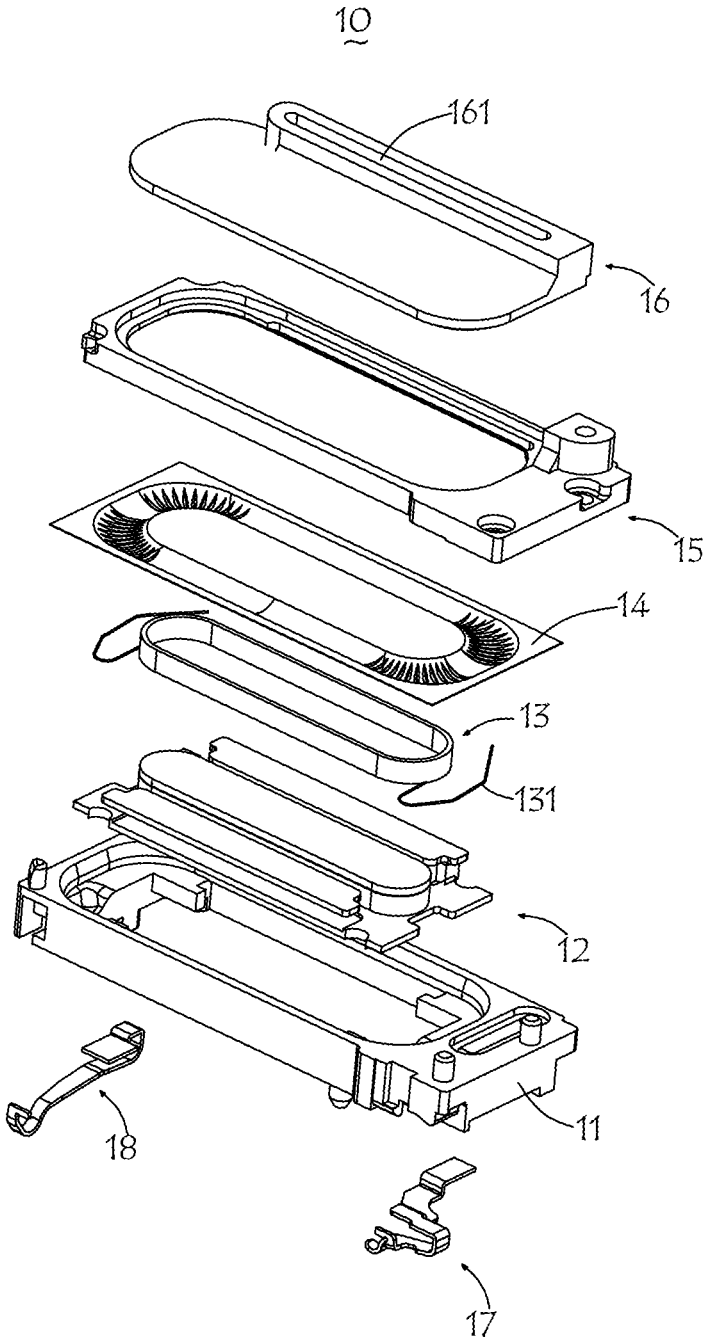
FIG. 1 is an isometric exploded view of a miniature speaker in accordance with a first exemplary embodiment of the present disclosure.
Figure 2:
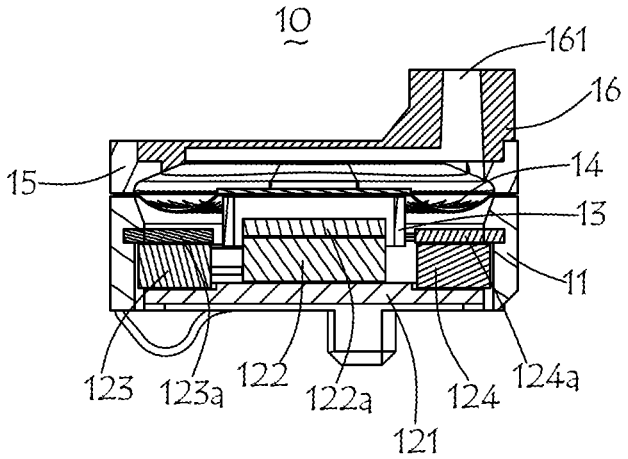
FIG. 2 is a cross-sectional view of the miniature speaker in FIG. 1.

Referring to FIGS. 1 and 2, a miniature speaker 10 in accordance with an exemplary embodiment of the present disclosure comprises a frame 11 providing a receiving space, a magnetic circuit 12 accommodated in the receiving space, a voice coil 13 electrically connected to an external circuit (not shown), a diaphragm 14 driven by the voice coil 13 for generating audible sounds, a cover 15 pressing a periphery of the diaphragm 14 for fixing the diaphragm 14 to the frame 11, and a sound guide plate 16 attached to the cover 15. The sound guide plate 16 comprises a sound pipe 161 for transmitting the sounds generated by the diaphragm 14 to the outside of the speaker. The sound guide plate 16 is actually an optional component, and sounds could be transmitted outside directly from the diaphragm 14 without the sound guide plate 16. In addition, the miniature speaker 10 includes a plurality of contacts for electrically connecting the voice coil 13 to the external circuit. In this embodiment, the contacts includes a first contact 17 mounted on the frame 11 and a second contact 18 spaced from the first contact 17.

The magnetic circuit 12 comprises a magnetic gap for partially receiving the voice coil 13. Referring especially to FIG. 2, the magnetic circuit comprises a lower plate 121, a first magnet 122 positioned on a central portion of the lower plate 121, a first pole plate 122*a* attached on a top of the first magnet 122, a second magnet 123 positioned on the lower plate 121 separated from the first magnet 122, a second pole plate 123*a* attached on a top of the second magnet 123, a third magnet 124 positioned on the lower plate 121 away from the second magnet 123, and a third pole plate 124*a* attached on a top of the third magnet 123. While assembled, the first magnet 122 locates on the lower plate 121 between the second magnet 123 and the third magnet 124. When the voice coil 13 is electrified, the voice coil 13 is activated to vibrate due to the Lorenz Force generated by the magnetic circuit 12. Accordingly, the diaphragm 14 is driven by the voice coil 13 to vibrate, and sounds are thus produced.

Figure 3:
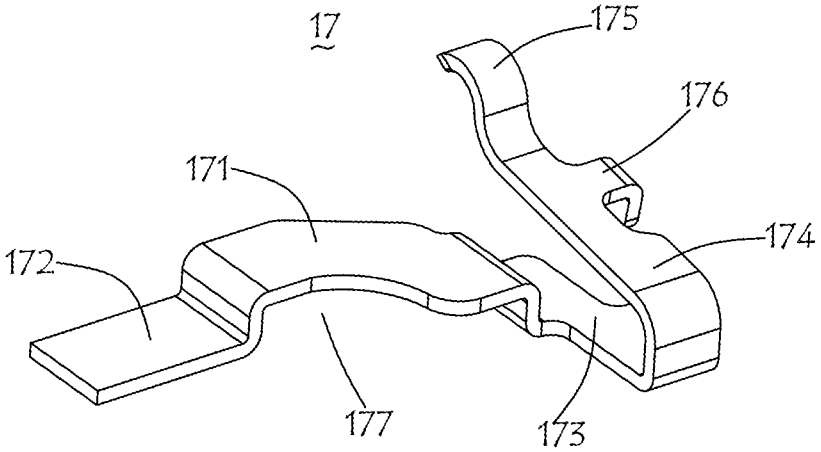
FIG. 3 is an isometric view of a contact used in the miniature speaker.
Figure 4:
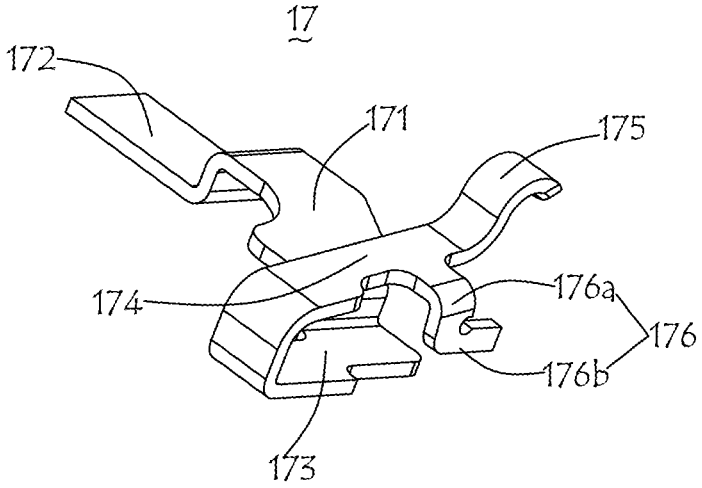
FIG. 4 is an isometric view of the contact in FIG. 3, but from another aspect.

Referring to FIGS. 3-4, the first contact 17 of the miniature speaker is made by stamping and bending a metal plate. The first contact 17 includes a base plate 171, a soldering pad 172 extending vertically from one end of the base plate 171 for electrically soldering a lead wire 131 of the voice coil thereon, a connecting portion 173 extending vertically from the other end of the base plate 171, and an elastic arm 174 extending obliquely from the connecting portion 173. A plane where the base plate locates is not coplanar with the planes where the soldering pad 172 and the connecting portion 173 locates, by which a recess 177 is accordingly formed. The first contact 17 further comprises a latch 176 extending from a side of the elastic arm 176, and a contacting tip 175 extending obliquely from an end of the elastic arm 174. The latch 176 locates between the contacting tip 175 and the joint of the elastic arm 174 and the connecting portion 173. The latch 176 comprises a first portion 176*a* extending from the side of the elastic arm 174, and a second portion 176*b* extending from a distal end of the first portion 176*a*. The second portion is substantially perpendicular to the first portion 176*a*.

Figure 5:
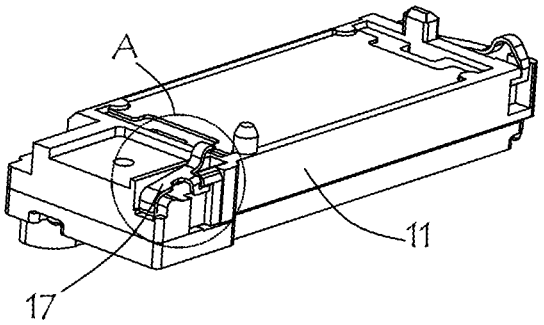
FIG. 5 is an assembled view of the miniature speaker, especially showing the engagement between the contact and a frame of the miniature speaker.
Figure 6:
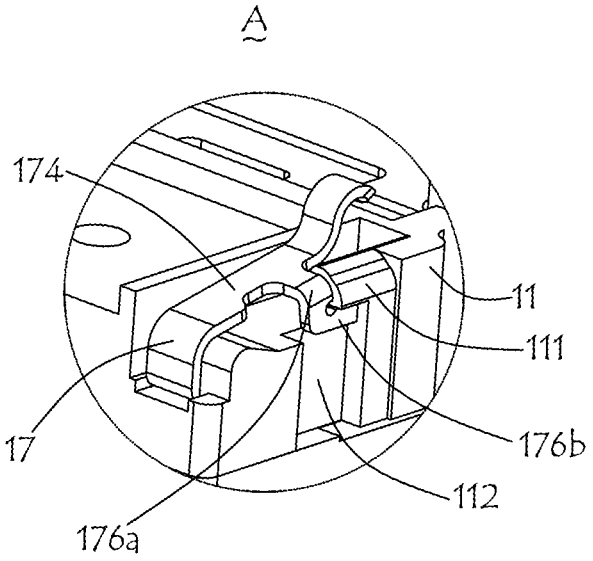
FIG. 6 is an enlarged view of the circled part A in FIG. 5.
Figure 7:
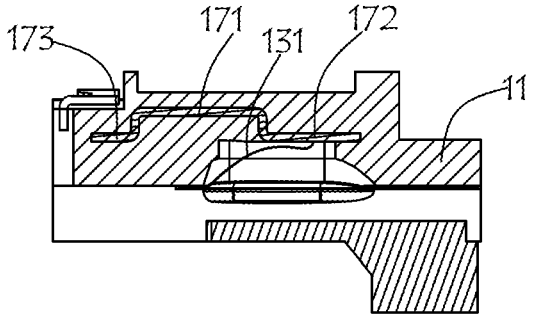
FIG. 7 is a cross-sectional view of the miniature speaker, especially showing the position of the contact inside the frame.

Referring to FIG. 5, while assembled with the frame 11, the first contact 17 locates at a periphery of the frame 11. Referring to FIGS. 6-7, the base plate 171, the soldering pad 172, and a part of the connecting portion 173 are insert-molded in the frame 11. A surface of the soldering pad 172 is connected to the lead wire 131 of the voice coil. Due to the recess formed by the base plate 171, the soldering pad 172 and the connecting portion 173, the first contact 17 is firmly positioned in the frame 11. The frame 11 includes a protrusion 111 corresponding to the latch 176, and a slot 112 below the protrusion 111. While assembled, the second portion 176*b* is received in the slot 112 and engages with a lower surface of the protrusion 111. By virtue of the configuration of the first portion 176*a* and the second portion 176*b*, the latch 176 hooks the protrusion 111 for limiting the upward movement of the elastic arm 174.

Figure 8:
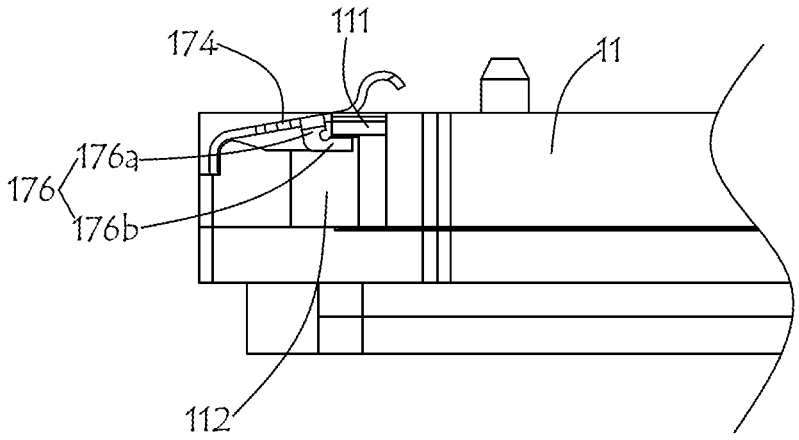
FIG. 8 is a side view of the miniature speaker, the contact being at a free state.
Figure 9:
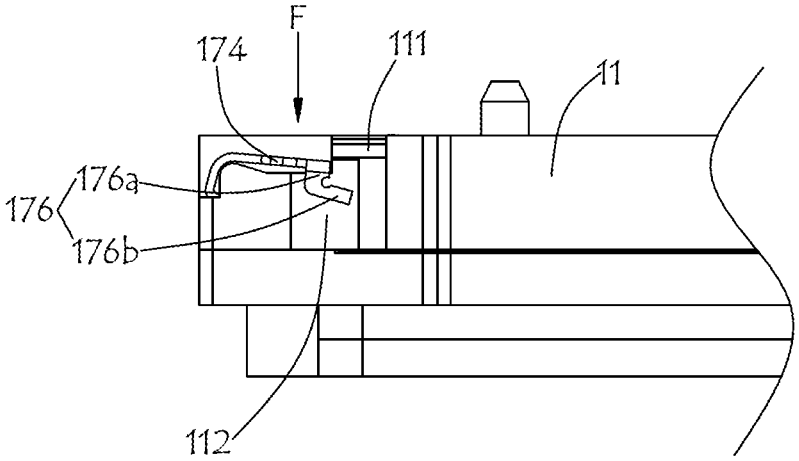
FIG. 9 is similar to FIG. 8, the contact being at a pressed state.

Referring to FIG. 8-9, when the miniature speaker does not engage with an external component, such as a mother board of a mobile phone, the first contact 17 is restricted at an initial position by the engagement of the latch 176 and the protrusion 111 of the frame 11. Another word, the elastic arm 174 is at a balanced position due to the elastic force generated by the elastic deformation of the elastic arm 174 and an opposite reaction force generated by the engagement between the second portion 176*b* and the protrusion 111. When the miniature speaker engages an external component, the elastic arm 174 is forced to deform downwardly by the force F generated by the external component. Due to the force F, the elastic arm 174 deforms downwardly, and the second portion 176*b* moves downwardly along the slot 112. While the force F withdraws, the elastic arm 174 resumes to the initial position and is restricted by the engagement between the second portion 176*b* and the protrusion 111.

The disclosure provides a miniature speaker having a frame and a plurality of contacts fixed by the frame. The contact includes an elastic arm, a contacting tip located at a distal end of the elastic arm, and a latch extending from the elastic arm and located a certain distance from the contacting tip.

As the latch is located at a position between the contacting tip and the joint of the elastic arm and the connecting portion, the size of the contact is accordingly reduced, and the stability of the contact is thus improved.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A miniature speaker, comprising:

a frame providing a receiving space and including a protrusion at a periphery of the frame;

a magnetic circuit accommodated in the receiving space, the magnetic circuit forming a magnetic gap;

a voice coil partially received in the magnetic gap, the voice coil having a lead wire;

a diaphragm activated by the voice coil for generating sounds;

a plurality of contacts fixed by the frame for electrically connected to the lead wire, one of the contacts comprising a base plate assembled with the frame, a soldering pad electrically connected to the lead wire of the voice coil, a connecting portion extending from the base plate, an elastic arm extending from the connecting portion, a contacting tip located at a distal end of the elastic arm, and a latch extending from a side of the elastic arm corresponding to the protrusion of the frame for engaging with the protrusion;

the latch locating at a position of the elastic arm between the contacting tip and a junction where the elastic arm extends from the connecting portion.

2. The miniature speaker as described in claim 1, wherein the base plate is embedded in the frame and is non-coplanar with the soldering pad thereby forming a recess engaging with the frame.

3. The miniature speaker as described in claim 1, wherein the latch of the contact includes a first portion extending vertically from the side of the elastic arm, and a second portion extending perpendicularly from the first portion, the second portion engaging with a lower surface of the protrusion.

4. The miniature speaker as described in claim 3, wherein the frame further includes a slot below the protrusion, and the second portion of the latch locates in the slot.

5. The miniature speaker as described in claim 1 further comprising a cover pressing on a periphery of the diaphragm for fixing the diaphragm.

6. The miniature speaker as described in claim 1 further comprising a sound guide plate having a sound pipe for transmitting the sounds generated by the diaphragm.

7. The miniature speaker as described in claim 1, wherein the contact includes a first contact located at one side of the frame, and a second contact located opposed to the first contact.

* * * * *